US009089248B2

(12) United States Patent
Yoo

(10) Patent No.: US 9,089,248 B2
(45) Date of Patent: Jul. 28, 2015

(54) FAN MOTOR APPARATUS HAVING DIFFUSER UNIT FOR VACUUM CLEANER

(75) Inventor: Dong-hun Yoo, Gwangju (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 859 days.

(21) Appl. No.: 12/641,503

(22) Filed: Dec. 18, 2009

(65) Prior Publication Data

US 2010/0209271 A1 Aug. 19, 2010

Related U.S. Application Data

(60) Provisional application No. 61/152,762, filed on Feb. 16, 2009.

(30) Foreign Application Priority Data

Apr. 29, 2009 (KR) ..... 10-2009-0037697

(51) Int. Cl.

| | |
|---|---|
| ***F04D 29/70*** | (2006.01) |
| ***A47L 9/22*** | (2006.01) |
| ***A47L 5/22*** | (2006.01) |
| ***A47L 9/10*** | (2006.01) |
| ***F04D 29/40*** | (2006.01) |
| ***F04D 29/44*** | (2006.01) |
| ***A47L 5/12*** | (2006.01) |
| ***A47L 9/00*** | (2006.01) |
| ***A47L 9/12*** | (2006.01) |

(52) U.S. Cl.

CPC ... *A47L 5/22* (2013.01); *A47L 5/12* (2013.01); *A47L 9/0081* (2013.01); *A47L 9/102* (2013.01); *A47L 9/122* (2013.01); *A47L 9/22* (2013.01); *F04D 29/40* (2013.01); *F04D 29/44* (2013.01); *F04D 29/441* (2013.01); *F04D 29/70* (2013.01)

(58) Field of Classification Search

CPC ..... F04D 29/40; F04D 29/44; F04D 29/70; A47L 5/12; A47L 9/102; A47L 9/22

USPC ..... 417/423.2, 423.14, 423.9

See application file for complete search history.

(56) References Cited

U.S. PATENT DOCUMENTS

| | | | | |
|---|---|---|---|---|
| 2,018,207 | A * | 10/1935 | Giambertoni | 96/382 |
| 3,675,268 | A | 7/1972 | Nordeen | |
| 6,289,553 | B1 * | 9/2001 | Dyson | 15/347 |
| 6,428,288 | B1 * | 8/2002 | King | 417/366 |
| 6,532,621 | B2 * | 3/2003 | Stephens et al. | 15/412 |

(Continued)

FOREIGN PATENT DOCUMENTS

| | | |
|---|---|---|
| EP | 1 929 915 | 6/2008 |
| JP | 07-039472 | 2/1995 |
| JP | 07-124072 | 5/1995 |

*Primary Examiner* — Christopher Bobish

(74) *Attorney, Agent, or Firm* — NSIP Law

(57) ABSTRACT

A fan motor apparatus of a vacuum cleaner having a diffuser unit is provided. The fan motor apparatus of a vacuum cleaner includes a fan motor unit into and from which an air stream is introduced and discharged in the same direction, and a diffuser unit having an air suction area to discharge an air stream to the fan motor unit through a fluid passage surface, the fluid passage surface through which an air stream is drawn in and discharged out of the diffuser. An air discharge area of the diffuser unit may receive the air stream discharged from the fan motor unit, and distribute and discharge the air stream through a perimeter of the air suction area of the fluid passage surface.

19 Claims, 4 Drawing Sheets

(56) References Cited * cited by examiner

U.S. PATENT DOCUMENTS

| | | | | |
|---|---|---|---|---|
| 7,258,714 | B2 | 8/2007 | Genn et al. | |
| 2005/0039426 | A1 | 2/2005 | Genn | |
| 2006/0117518 | A1 | 6/2006 | Hwang | |
| 2007/0067948 | A1 * | 3/2007 | Biere | 15/412 |

FAN MOTOR APPARATUS HAVING DIFFUSER UNIT FOR VACUUM CLEANER

CROSS-REFERENCE TO RELATED APPLICATIONS

This application claims the benefit under 35 U.S.C. §119 (e) of U.S. Provisional Application No. 61/152,762, filed on Feb. 16, 2009, in the United States Patent and Trademark Office, and under 35 U.S.C. §119(a) of a Korean Patent Application No. 10-2009-0037697, filed on Apr. 29, 2009, in the Korean Intellectual Property Office, the disclosures of which are incorporated herein by reference for all purposes.

BACKGROUND

1. Field

The following description relates to a vacuum cleaner, and more particularly, to a fan motor apparatus for use in an industrial, domestic, or commercial vacuum cleaner, which has a diffuser unit formed therein.

2. Description of the Related Art

A vacuum cleaner generally may have a fan motor apparatus to forcefully draw in external air stream. As the fan motor apparatus starts operating, the vacuum cleaner starts cleaning operation by drawing in external air including foreign matters of the target surface. The foreign matters are then filtered out within the vacuum cleaner, the cleaned air is discharged out of the vacuum cleaner, and the vacuum cleaner completes cleaning operation.

However, as the vacuum cleaner is operated, noise is generated due to operation of the fan motor apparatus and air current discharging out of the fan motor apparatus.

Furthermore, an air stream, which is discharged out of the fan motor apparatus, can include minute matters which are left even after the dust removal operation of the vacuum cleaner. These minute matters may include carbon dusts which are separated from a carbon brush employed in the motor. Problems may arise if such minute dusts or carbon dusts are not completely removed by the discharge filter, and carried along the discharged air stream.

Accordingly, in order to decrease noise and to increase efficiency of removing minute dust at the discharge filter unit, suggestions have been made to distribute an air stream in a uniform manner before discharging it.

For example, U.S. Pat. No. 7,258,714 and U.S. Patent Application Publication No. 2005/0039426 disclose an arrangement including a plurality of vanes along a direction of airflow ("conventional art 1"). Additionally, U.S. Patent Application Publication No. U.S. 2007/0067948 discloses an arrangement of a plurality of holes formed in an outlet of a motor housing ("conventional art 2"), and Korean Patent Publication No. 2006-62145 discloses a fan motor unit having an inlet vertically formed to face a downward direction and a casing having a plurality of air-passing holes in an air discharge portion of the fan motor unit ("conventional art 3").

Specifically, conventional art 1 suggests that noise generated from an air discharge may be decreased by drawing in airflow inside the vacuum cleaner, which is removed of dust, into the fan motor unit, and distributing the discharged air through a motor housing having a plurality of vanes so that the discharge pressure may be distributed.

However, in the case of conventional art 1, since airflow is drawn through a side of the motor housing to be distributed and discharged, different passages have to be provided to serve as an air inlet and an air outlet. Accordingly, structure becomes complicated, the number of parts required to form airflow passages is increased, and the overall volume is increased.

According to conventional arts 2 and 3, the fan motor unit may be installed in a manner in which the lower portion faces a downward direction. Accordingly, airflow is drawn through the lower portion of the fan motor unit and discharged through the motor housing positioned above the fan motor unit. Conventional arts 2 and 3 may distribute airflow and decrease noise with a plurality of air-passing holes formed in the motor housing.

However, similar to the drawback with conventional art 1, conventional arts 2 and 3 also need separate passages to draw in and discharge out an air flow with respect to the fan motor unit. Accordingly, air passages may become complicated, the number of necessary parts is increased, and the overall size is increased.

Furthermore, according to conventional arts 2 and 3, since it may be necessary to form a passage to draw in airflow in a lower portion of the fan motor unit, the fan motor unit has to be installed at a relatively higher position, causing a vacuum cleaner to have a higher center of mass and subsequently a decreased stability.

SUMMARY

In one general aspect, there is provided a fan motor apparatus of a vacuum cleaner. The fan motor apparatus may include a fan motor unit into and from which an air stream is introduced and discharged in the same direction, and a diffuser unit which may include a fluid passage surface through which an air stream is drawn in and discharged out of the diffuser, an air suction area to discharge an air stream to the fan motor unit, and an air discharge area to receive the air stream discharged from the fan motor unit, and distribute and discharge the air stream through a perimeter of the air suction area of the fluid passage surface.

The diffuser unit may include a passage partitioning wall formed therein to separate the air suction area and the air discharge area from each other.

The diffuser unit may further include an inlet pipe formed at a center of the fluid passage surface to introduce the air stream into the air suction area.

The diffuser unit may further include a discharge filter unit inserted in an outer side of the inlet pipe.

The diffuser unit may further include a discharge filter fixing portion to fix the discharge filter unit on the fluid passage surface.

The discharge filter fixing portion may include comprises at least one of: an outer circumferential discharge filter fixing portion into which a lower end of an outer casing forming an outer side of the discharge filter unit is inserted and an inner circumferential discharge filter fixing portion into which a lower end of an inner casing corresponding to the outer side of the inlet pipe of the discharge filter unit is inserted.

The outer circumferential discharge filter fixing portion and the inner circumferential discharging filter fixing portion may further include a sealing member for sealing thereof.

The air discharge area may be formed to have a larger size than the air suction area.

The diffuser unit may further include a discharge portion having a plurality of discharge holes formed in the fluid passage surface which corresponds to the discharge area.

The discharge portion may be formed to surround the air suction area.

The diffuser unit may further include an upper diffuser cover having an inlet pipe formed on the fluid passage surface, an outlet portion formed on a surface of the fluid passage surface located on an outer side of the inlet pipe, and an upper cover passage partitioning wall extended toward a lower diffuser cover. The lower diffuser cover may have a diffuser unit outlet portion, a diffuser unit inlet portion, and a lower cover passage partitioning wall extended toward the upper diffuser cover.

The air stream discharged from the air discharge area may be in a direction opposite to the air stream introduced into the air suction area.

The air stream discharged from the air discharge area may be discharged through a perimeter of the area where the air stream is introduced into the air suction area.

In another aspect, a diffuser apparatus for use in a fan motor apparatus of a vacuum cleaner is provided. The diffuser apparatus may include a fluid passage surface including an inlet pipe and a discharge area, the inlet pipe and discharge area positioned on the same side of the diffuser apparatus, a suction area configured to receive an air stream from the inlet pipe, a diffuser outlet portion configured to discharge the air stream to a fan motor unit of the fan motor apparatus, a diffuser inlet portion configured to draw the air stream into the diffuser from the fan motor unit, and a diffuser discharge area configured to discharge the air stream through the discharge area of the fluid passage surface.

The suction area, diffuser outlet portion, diffuser inlet portion and diffuser discharge area may be positioned on at least one different side of the diffuser from the inlet pipe and discharge area of the fluid passage surface.

The discharge area of the fluid passage surface may include a plurality of discharge holes.

Other features and aspects will be apparent from the following detailed description, the drawings, and the claims.

DETAILED DESCRIPTION

The following detailed description is provided to assist the reader in gaining a comprehensive understanding of the methods, apparatuses, and/or systems described herein. Accordingly, various changes, modifications, and equivalents of the systems, apparatuses and/or methods described herein will be suggested to those of ordinary skill in the art. Also, descriptions of the well-known functions and constructions may be omitted for increased clarity and conciseness.

Referring to the accompanying drawings, the fan motor apparatus 1 may include a diffuser unit 100 and a fan motor unit 130.

Figure 4:
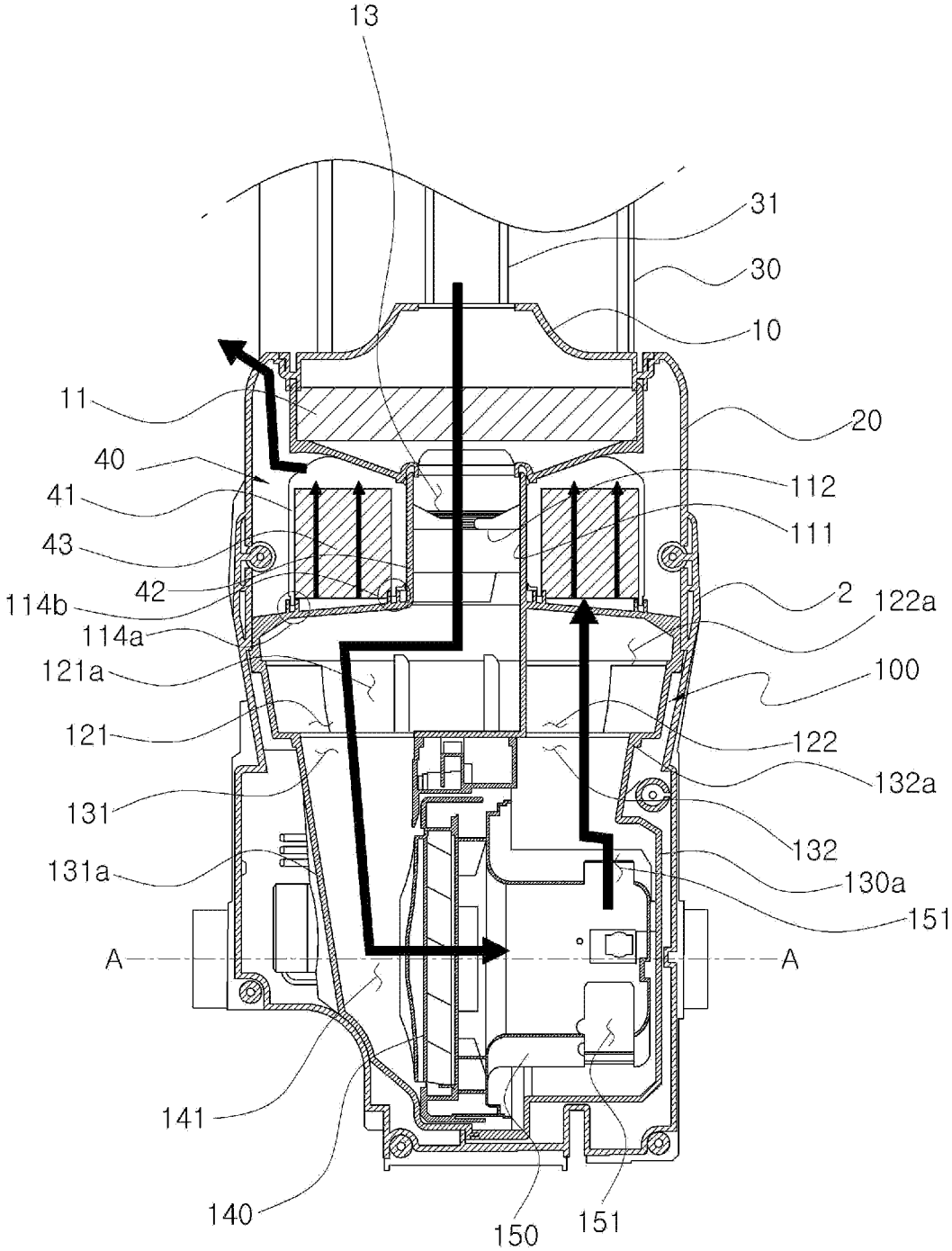
FIG. 4 is a diagram illustrating a partial, cross-section bottom view of an exemplary vacuum cleaner, illustrating the exemplary fan motor apparatus of FIG. 1 in a mounted state, and an exemplary air passage structure in the lower portion of the exemplary vacuum cleaner.

The fan motor unit 130 may be installed within the vacuum cleaner 2 (FIG. 4) and form an air passage to draw in an air stream and an air passage to discharge an air stream. The fan motor unit 130 may include a motor 150 to which an impeller unit 140 may be connected (FIG. 4), and a fan motor casing 130*a*. Specifically, FIG. 4 illustrates an exemplary casing of the motor 150.

The fan motor casing 130*a* may house the motor 150 to which the impeller unit 140 may be connected, and receive an air stream through a suction area 121*a* of the diffuser unit 100 and discharge the air stream through a discharge area 122*a*.

Accordingly, the fan motor casing 130*a* may include a fan motor inlet pipe 131*a* connected fluidly to the diffuser outlet portion 121, and a fan motor outlet pipe 132*a* connected fluidly to the diffuser inlet portion 122, both formed on an upper surface. An opening of the fan motor inlet pipe 131*a* which may be connected to the diffuser outlet portion 121 is a fan motor inlet portion 131, and an opening of the fan motor outlet pipe 132 which is connected to the diffuser inlet portion 122 is a fan motor outlet portion 132.

When dusts are removed from an air stream in a centrifugal separator (not illustrated) provided in the dust separating apparatus, the diffuser unit 100 may draw the dust-removed air stream into the fan motor unit 130 so that the air stream discharged from the fan motor apparatus 130 may be distributed to the neighboring area and discharged to the discharge filter unit 40.

To do the abovementioned function, the diffuser unit 100 may include an upper diffuser cover 110 and a lower diffuser cover 120 which may be connected to each other to form an air suction area 121*a* and an air discharge area 122*a* which may be separated from each other.

The upper diffuser cover 110 may include an outer circumferential upper cover wall 110*a*, an inlet pipe 111, a discharge portion 113, an outer circumferential discharge filter fixing portion 114*a*, an inner circumferential discharge filter fixing portion 114*b*, and an upper cover passage partitioning wall 115.

The outer circumferential upper cover wall 110*a* may extend downwardly from a lower surface of the outer circumference of the upper diffuser cover 110.

Figure 3:
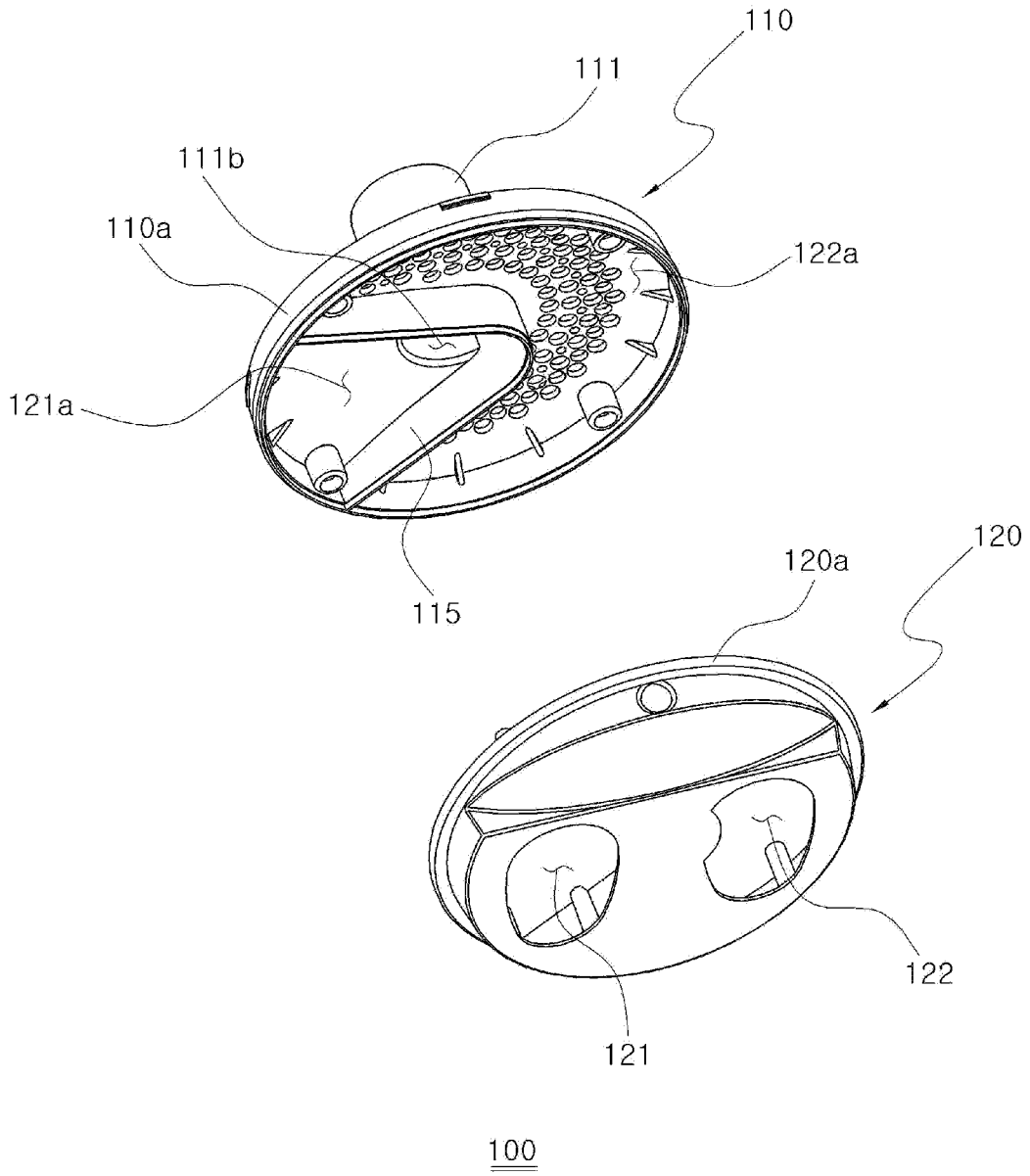
FIG. 3 is a diagram illustrating an exploded, perspective bottom view of an exemplary diffuser unit.

The inlet pipe 111 may have open upper and lower portions, and may be constructed to have a grill member 112 formed therein. The open upper portion of the inlet pipe 111 may be an inlet pipe inlet portion 111*a*, and the open lower portion may be an inlet pipe outlet portion 111*b* (FIG. 3). Accordingly, the inlet pipe 111 with the above-explained structure may be formed on an upper surface of the upper diffuser cover 100.

The discharge portion may include a plurality of discharge holes 113*a* formed in an upper surface of the upper diffuser cover 110 which corresponds to the discharge area 112*a*.

The outer circumferential discharge filter fixing portion 114*a* and the inner circumferential discharge filter fixing portion 114*b* may be formed in an annular shape and in a coaxial relationship with each other. The area between the outer circumferential discharge filter fixing portion 114*a* and the inner circumferential discharge filter fixing portion 114*b* may include the discharge portion.

The outer circumferential discharge filter fixing portion 114*a* may include a first protrusion 114'*a* and a second protrusion 114"*a* extended from the outer circumference of the upper surface of the upper diffuser cover 110, both in an annular form and in a coaxial relationship with each other. The inner circumferential discharge filter fixing portion 114*b* may include a third protrusion 114'*b* and a fourth protrusion 114"*b* extended from an outer circumference adjacent to the inlet pipe 111, both in an annular shape and in a coaxial relationship with each other. A sealing member (not illustrated) may be provided in an area between the first and second protrusions 114'*a*, 114"*a*, and in an area between the third and fourth protrusions 114'*b*, 114"*b*.

The outer circumferential discharge filter fixing portion 114*a* and the inner circumferential discharge filter fixing portion 114*b* are one non-limiting example of the discharge filter fixing portion.

The upper cover passage partitioning wall 115 may be extended from a lower surface of the upper diffuser cover 110, and connected to the lower cover passage partitioning wall 125 to partition an inner area of the diffuser unit 100 into the suction area 121*a* and the discharge area 122*a*. The inlet pipe outlet portion 111*b* may be connected fluidly to the suction area 121*a*.

The upper diffuser cover 110 with the above-explained structure may be a fluid passage surface through which an air stream is drawn in and discharged out.

The lower diffuser cover 120 may include an outer circumferential lower cover wall 120*a* and the lower cover passage partitioning wall 125.

The outer circumferential lower cover wall 120*a* may be extended upwardly from an outer circumferential upper surface of the lower diffuser cover 120 to partition the upper area of the lower diffuser cover 120 into the suction area 121*a* and the discharge area 122*a*.

The lower cover passage partitioning wall 125, in association with the upper cover passage partitioning wall 115 formed in the upper diffuser cover 110, may form an outer side of the diffuser unit 100 having the suction area 121*a* and the discharge area 122*a*, in the inner area of the outer circumferential lower cover wall 120*a*. In order to maximize the surface of discharged air diffusion, the discharge area 122*a* may desirably be formed as large as possible.

The diffusion unit outlet portion 121 may be formed on a surface on which the suction area 121*a* of the lower diffuser cover 120 is formed. The diffuser unit inlet portion 122 may be formed on a surface on which the discharge area 122*a* is formed. Herein, the diffuser unit outlet portion 121 and the diffuser unit inlet portion 122 each may correspond to the opening through which air stream is discharged from, and the opening through which air stream is drawn into the diffuser unit 100.

The upper diffuser cover 110 and the lower diffuser cover 120 may be connected to each other to form the diffuser unit 100. In such a situation, the lower surface of the upper cover passage partitioning wall 115 and the upper surface of the lower cover partitioning wall 125 may be closely contacted with each other, to thereby partition the inner area of the diffuser unit 100 into the suction area 121*a* and the discharge area 122*a*. A surface where the inlet pipe 111 and the discharge portion 113 to draw in air stream into the suction area 121*a* are formed, corresponds to the fluid passage surface through which the air stream is drawn in and discharged.

The diffuser unit 100, which may be constructed as explained above, may be connected to the fan motor unit 130 at the upper portion of the fan motor unit 130, and assembled into the fan motor apparatus 1. In such a situation, the diffuser unit outlet portion 121 may be connected fluidly to the fan motor inlet pipe 131*a*, and the diffuser unit inlet portion 122 may be connected fluidly to the fan motor outlet pipe 132*a*. Accordingly, the fan motor inlet portion 131 and the fan motor outlet portion 132 may have small cross sections and simple structures, and subsequently may have an increased sealing efficiency when connected to the diffuser unit 100. Even when it is necessary to use a separate gasket for sealing, the work process may be convenient and cost less.

Figure 1:
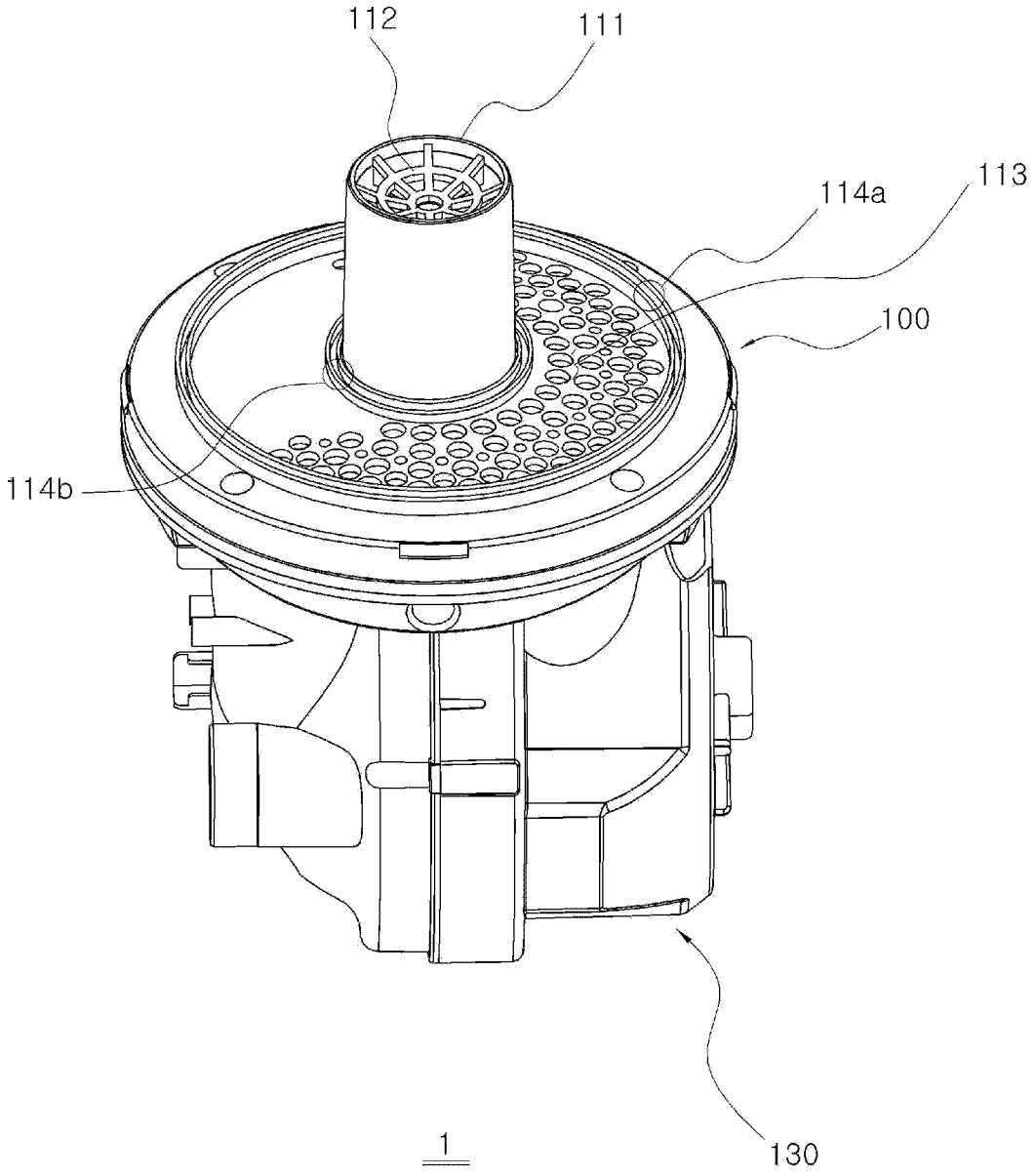
FIG. 1 is a diagram illustrating a perspective view of an exemplary fan motor apparatus.
Figure 2:
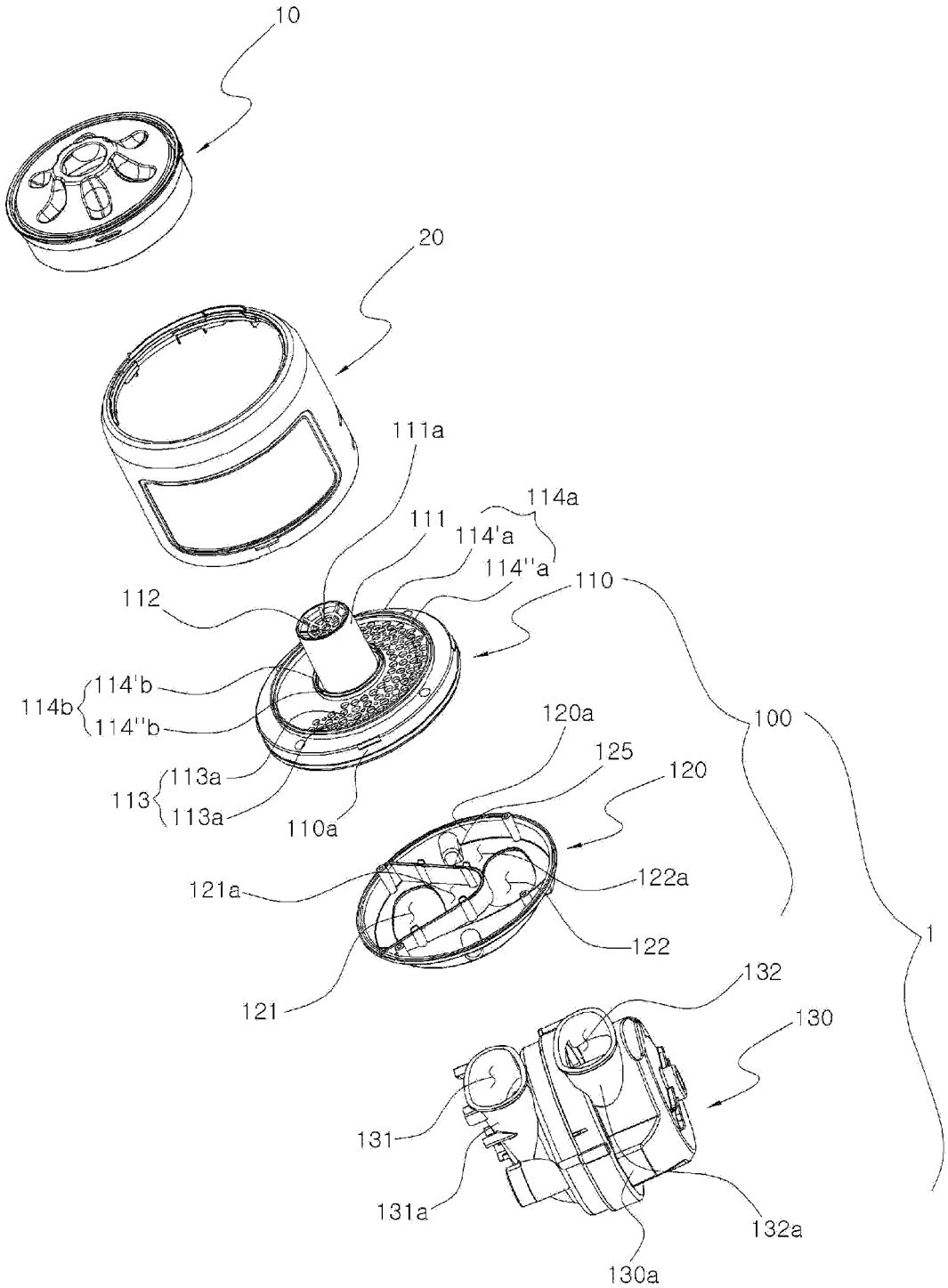
FIG. 2 is a diagram illustrating an exploded perspective view of the exemplary fan motor apparatus of FIG. 1.

Referring to FIG. 2, the pre-filter unit 10 may fixedly support a pre-filter 11 which may separate foreign substances from an air stream introduced into the fan motor unit 130. The blower duct 20, when connected to the upper portion of the fan motor apparatus 1, may fixedly support the diffuser unit 100 and the pre-filter unit 10 from within the fan motor apparatus 1.

Referring to FIG. 4, the fan motor apparatus 1 may be installed inside the vacuum cleaner 2 in a manner in which the axis (not illustrated) of the motor 140 may be coaxial with the axis of the wheels (not illustrated), that is, with the axis A-A of the vacuum cleaner 2, and in which the diffuser unit 100 may be positioned at an upper portion.

After that, the discharge filter unit 40 may be inserted in an outer circumference of the inlet pipe 111. The discharge filter unit 40 may be fixed to the upper surface of the diffuser unit 100, as the lower end of the outer casing 41 of the discharge filter unit 40 may be inserted in a groove between the first and second protrusions 114'*a* and 114"*a* of the outer circumferential discharge filter fixing portion 114*a*. The lower end of the inner casing 42 of the discharge filter unit 40 may be inserted in a groove between the third and fourth protrusions 114'*b* and 114"*b* of the inner circumferential discharge filter fixing portion 114*b*.

The blower duct 20 may be connected to the upper portion of the diffuser unit 100 to which the discharge filter unit 40 is connected, in a manner in which the outer side of the diffuser unit 100 may be inserted into the blower duct 20 from below.

After the blower duct 20 is connected, the pre-filter unit 10 housing the pre-filter 11 may be connected to the upper opening of the blower duct 20, in a manner in which the filter outlet portion 13 of the pre-filter unit 10 may be inserted inward from above the blower duct 20 and connected fluidly to the inlet pipe 111.

When the fan motor apparatus 1 having the diffuser unit 100, and the discharge filter unit 40, and the blower duct 20 are assembled to the vacuum cleaner 2, a dust separating apparatus may be removably connected to the upper portion of the pre-filter unit 10. When the dust separating apparatus is mounted in the vacuum cleaner 2, a discharge pipe 31 of the circumferential separator (not illustrated) housed within a dust bin 30 may be connected fluidly to the inner area of the pre-filter unit 10 to draw an air stream, from which foreign matters may be removed at the circumferential separator, into the pre-filter unit 10.

Accordingly, as the vacuum cleaner 2 assembled as explained above operates, an air stream, from which foreign matters may be removed at the circumferential separator, may be introduced into the pre-filter unit 10 through the circumferential separator discharge pipe 31. The air stream within the pre-filter unit 10 may be filtered by the pre filter 11. The air stream filtered by the pre-filter 11 may then be introduced into the suction area 121*a* of the diffuser unit 100 through the inlet pipe 111. The air stream in the suction area 121*a* may be introduced into the fan motor unit 130 through the fan motor inlet pipe 131*a* which is connected fluidly to the diffuser outlet portion 121. The air stream within the fan motor unit 130 may be introduced into the discharge area 122*a* of the diffuser unit 100 through the fan motor outlet pipe 132*a*.

The air stream in the discharge area 122*a* of the diffuser unit 100 may be diffused across the entirety of the discharge area 113 through the plurality of discharge holes 113*a* formed in the discharge area 113. As a result, an air stream may have a constant flow rate across the entirety of the discharge area 113. Because speed may be slowed down in a uniform manner, discharging noise may be reduced.

The air stream, which may be diffused across the entirety of the discharge portion 113 and discharged, may be filtered by the discharge filter 43 of the discharge filter unit 40 connected to the upper portion of the diffuser unit 100 to be removed of minute dusts, and discharged out through the discharge port (not illustrated) of the vacuum cleaner 2. When the air stream is discharged from the discharge area 122*a*, the air stream may be diffused uniformly over the whole discharge area and may have a decreased velocity. Accordingly, the air stream discharged from the diffuser unit 100 may have an increased area of contact with the discharge filter 43 for an extended duration of time, as the air stream passes the discharge filter unit 40. As a result, the efficiency of removing minute dusts may be increased.

Furthermore, since the fan motor apparatus 1 may be constructed in a manner in which an air stream may be introduced through a center of the fluid passage surface of the diffuser unit 100 (i.e., upper surface of the diffuser unit 100), and discharged through the perimeter of the fluid passage surface, the passage of the air passing the fan motor apparatus 1 may be simplified.

By simplifying an air passage structure which passes the fan motor apparatus 1, not only the fan motor apparatus 1, but also the vacuum cleaner 2 may be compact-sized. Accordingly, the manufacture cost of the fan motor apparatus 1 and the vacuum cleaner 2 may be reduced, and the productivity may be increased.

Furthermore, the vacuum cleaner 2 may be compact-sized to directly increase user convenience.

As explained above, the diffuser unit may cause an air stream introduced into the fan motor unit and an air stream discharged from the fan motor unit to flow the center and the perimeter of the center from the same direction. As a result, the discharge passage has a simple structure, requires a reduced number of parts, and is reduced in size.

According to the reduced number of parts and size, the vacuum cleaner 2 may be compact sized, and may be fabricated with convenience and at a reduced cost.

Furthermore, since a discharged air stream is distributed in a uniform manner and has a reduced flow velocity, noise of discharged air may be reduced, and subsequently, user convenience may be increased.

Furthermore, since a discharged air stream is distributed in a uniform manner and has a reduced flow velocity, air stream may contact an increased area of the discharge filter for an increased duration of time, and as a result, efficiency of removing minute dusts or carbon dusts may be increased, along and a user's hygienic safety.

A number of exemplary embodiments have been described above. Nevertheless, it will be understood that various modifications may be made. For example, suitable results may be achieved if the described techniques are performed in a different order and/or if components in a described system, architecture, device, or circuit are combined in a different manner and/or replaced or supplemented by other components or their equivalents. Accordingly, other implementations are within the scope of the following claims.

What is claimed is:

1. A fan motor apparatus of a vacuum cleaner comprising a dust separator, the fan motor apparatus being disposed at a rear of the dust separator to suction air passing through the dust separator, the fan motor apparatus comprising:

a fan motor unit having a fan motor inlet portion into which an air stream is introduced and a fan motor outlet portion from which the air stream is discharged, the fan motor inlet portion and the fan motor outlet portion disposed on the same side of the fan motor unit; and a diffuser unit comprising:

a fluid passage surface comprising an inlet pipe through which the air stream is drawn in and a discharge portion comprising a plurality of discharge holes through which the air stream is discharged out of the diffuser unit, the inlet pipe and the plurality of discharge holes of the discharge portion positioned on the same side of the diffuser unit;

an air suction area to discharge the drawn in air stream to the fan motor unit;

an air discharge area to receive the air stream discharged from the fan motor unit, and distribute and discharge the air stream about a periphery of the air suction area of the fluid passage surface.

2. The fan motor apparatus of claim 1, wherein the diffuser unit comprises a passage partitioning wall formed therein to separate the air suction area and the air discharge area from each other.

3. The fan motor apparatus of claim 1, wherein the inlet pipe is formed at a center of the fluid passage surface to introduce the air stream into the air suction area.

4. The fan motor apparatus of claim 3, wherein the diffuser unit further comprises a discharge filter unit inserted on an outer side of the inlet pipe.

5. The fan motor apparatus of claim 4, wherein the diffuser unit further comprises a discharge filter fixing portion to fix the discharge filter unit on the fluid passage surface.

6. A fan motor apparatus of a vacuum cleaner comprising a dust separator, the fan motor apparatus being disposed at a rear of the dust separator to suction air passing through the dust separator, the fan motor apparatus comprising:

a fan motor unit having a fan motor inlet portion into which an air stream is introduced and a fan motor outlet portion from which the air stream is discharged, the fan motor inlet portion and the fan motor outlet portion disposed on the same side of the fan motor unit; and a diffuser unit comprising:

a fluid passage surface comprising an inlet pipe through which the air stream is drawn in and a discharge portion through which the air stream is discharged out of the diffuser unit;

an air suction area to discharge the air stream to the fan motor unit; and an air discharge area to receive the air stream discharged from the fan motor unit, and distribute and discharge the air stream about a periphery of the air suction area of the fluid passage surface, wherein the diffuser unit comprises a discharge filter unit inserted on an outer side of the inlet pipe;

the discharge filter unit comprising a discharge filter fixing portion to fix the discharge filter unit on the fluid passage surface; and the discharge filter fixing portion comprises at least one of:

an outer circumferential discharge filter fixing portion into which a lower end of an outer casing forming an outer side of the discharge filter unit is inserted; and an inner circumferential discharge filter fixing portion into which a lower end of an inner casing corresponding to the outer side of the inlet pipe of the discharge filter unit is inserted.

7. The fan motor apparatus of claim 6, wherein the outer circumferential discharge filter fixing portion and the inner circumferential discharging filter fixing portion further comprises a sealing member for sealing thereof.

8. The fan motor apparatus of claim 1, wherein the air discharge area is formed to have a larger size than the air suction area.

9. The fan motor apparatus of claim 1, wherein the plurality of discharge holes are formed in the fluid passage surface.

10. The fan motor apparatus of claim 9, wherein the discharge portion is formed to partially surround the air suction area.

11. The fan motor apparatus of claim 1, wherein the diffuser unit comprises:

an upper diffuser cover having the inlet pipe formed on the fluid passage surface, the discharge portion formed on a surface of the fluid passage surface located on an outer side of the inlet pipe, and an upper cover passage partitioning wall extended toward a lower diffuser cover; and the lower diffuser cover having a diffuser unit outlet portion, a diffuser unit inlet portion, and a lower cover passage partitioning wall extended toward the upper diffuser cover.

12. The fan motor apparatus of claim 1, wherein the air stream discharged from the air discharge area is in a direction opposite to the air stream introduced into the air suction area.

13. A diffuser apparatus for use in a fan motor apparatus of a vacuum cleaner comprising a dust separator, the fan motor apparatus suctioning air passing through the dust separator, and the diffuser apparatus being disposed at a rear of the dust separator, the diffuser apparatus comprising:

a fluid passage surface including an inlet pipe and a discharge portion, the inlet pipe and discharge portion positioned on the same side of the diffuser apparatus;

a suction area configured to receive an air stream from the inlet pipe; a diffuser outlet portion configured to discharge the air stream to a fan motor unit of the fan motor apparatus;

a diffuser inlet portion configured to draw the air stream into the diffuser apparatus from the fan motor unit; and a diffuser discharge area configured to discharge the air stream through the discharge portion of the fluid passage surface, wherein the fluid passage surface of the diffuser apparatus is configured to be disposed between the fan motor unit and the dust separator in the vacuum cleaner.

14. The diffuser apparatus of claim 13, wherein the suction area, diffuser outlet portion, diffuser inlet portion and diffuser discharge area are positioned on a side of the diffuser apparatus opposite from a side of the diffuser apparatus on which the inlet pipe and discharge portion of the fluid passage surface are positioned.

15. The diffuser apparatus of claim 13, wherein the discharge portion of the fluid passage surface includes a plurality of discharge holes.

16. The fan motor apparatus of claim 9, further comprising a discharge filter fixing portion to fix a discharge filter unit on an outer side of the discharge portion having the plurality of discharge holes.

17. The fan motor apparatus of claim 9, wherein the discharge portion having the plurality of discharge holes is a substantially ring-shaped plate, with the inlet pipe formed inside to introduce the air stream into the air suction area.

18. The diffuser apparatus of claim 15, further comprising a discharge filter fixing portion to fix a discharge filter unit on an outer side of the discharge portion having the plurality of discharge holes.

19. The diffuser apparatus of claim 15, wherein the discharge portion having the plurality of discharge holes is a substantially ring-shaped plate, with the inlet pipe formed inside to introduce the air stream into the air suction area.

* * * * *